US006568555B1

(12) United States Patent
LoCascio

(10) Patent No.: US 6,568,555 B1
(45) Date of Patent: May 27, 2003

(54) GARBAGE RECEPTACLE WITH INCORPORATED LINER COMPARTMENT

(76) Inventor: Charles LoCascio, 58 Winthrop Ave., Yonkers, NY (US) 10710

( * ) Notice: Subject to any disclaimer, the term of this patent is extended or adjusted under 35 U.S.C. 154(b) by 0 days.

(21) Appl. No.: 09/974,615

(22) Filed: Oct. 6, 2001

Related U.S. Application Data

(60) Provisional application No. 60/254,805, filed on Dec. 13, 2000.

(51) Int. Cl.[7] ..... B65D 25/14

(52) U.S. Cl. ..... 220/495.07; 220/504; 220/909

(58) Field of Search ..... 220/495.07, 504, 220/909

(56) References Cited

U.S. PATENT DOCUMENTS 2,924,377 A * 2/1960 Lewis ..... 220/502
3,246,740 A * 4/1966 Guyer ..... 206/362
4,364,490 A * 12/1982 Lang et al. ..... 206/390
4,850,507 A * 7/1989 Lemongelli et al. ... 220/495.07
4,944,419 A * 7/1990 Chandler ..... 220/502
4,988,010 A * 1/1991 Pollak ..... 220/23.83
5,628,424 A * 5/1997 Gola ..... 220/495.07
5,738,239 A * 4/1998 Triglia ..... 206/815
5,833,114 A * 11/1998 Linnell ..... 220/1.5

* cited by examiner

*Primary Examiner*—Joseph M. Moy
(74) *Attorney, Agent, or Firm*—Goldstein & Lavas, P.C.

(57) ABSTRACT

A garbage receptacle with incorporated liner compartment including a container having an open upper end, a closed lower end, and a surrounding side wall therebetween. The container includes an intermediate lateral wall disposed upwardly of the closed lower end whereby a storage compartment is formed between the intermediate sliding shelf and the closed lower end. The surrounding side wall has an opening therein exposing the storage compartment. The opening has a removable access panel disposed therein. The storage compartment is dimensioned for holding a box of garbage liners therein. The intermediate sliding shelf has a central aperture therethrough, whereby a single liner is fed through the aperture to be extended up over the open upper end of the container.

3 Claims, 2 Drawing Sheets

GARBAGE RECEPTACLE WITH INCORPORATED LINER COMPARTMENT

CROSS REFERENCES AND RELATED SUBJECT MATTER

This application relates to subject matter contained in provisional patent application serial number 60/254,805, filed in the United States Patent & Trademark Office on Dec. 13, 2000.

BACKGROUND OF THE INVENTION

The present invention relates to a garbage receptacle with incorporated liner department and more particularly pertains to holding a quantity of garbage liners for convenient use.

Typically, in most households, a garbage can is used in the kitchen to hold household trash. The garbage can is usually lined with a garbage liner that will hold the trash until it is removed for permanent disposal. After the filled liner is removed, a new liner is needed to replace the old one. In most instances, the new garbage liners are stored in different places, such as a pantry, and must be retrieved in order to be placed within the garbage can. What is needed is a garbage can that not only holds a garbage liner while in use, but can also hold a container of garbage liners that can be drawn from when needed.

The present invention attempts to solve the abovementioned problem by providing a garbage receptacle that includes an incorporated compartment that will hold a container of garbage liners whereby the liners can be fed through an opening in a bottom wall of the garbage receptacle.

The use of combination waste receptacle devices is known in the prior art. More specifically, combination waste receptacle devices heretofore devised and utilized for the purpose of combining containers for waste with other functions are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,322,180 to Ker discloses a garbage can with means to hold an entire roll of replacement garbage bags in a bottom seat. U.S. Pat. No. 4,955,505 to Battaglia and U.S. Pat. No. 4,721,226 to Yurko disclose additional waste containers with means to hold garbage bags in the lower portion.

While these devices fulfill their respective, particular objective and requirements, the aforementioned patents do not describe a garbage receptacle with incorporated liner compartment for holding a quantity of garbage liners for convenient use.

In this respect, the garbage receptacle with incorporated liner compartment according to the present invention substantially departs from the conventional concepts and designs of the prior art, and in doing so provides an apparatus primarily developed for the purpose of holding a quantity of garbage liners for convenient use.

Therefore, it can be appreciated that there exists a continuing need for a new and improved garbage receptacle with incorporated liner compartment which can be used for holding a quantity of garbage liners for convenient use. In this regard, the present invention substantially fulfills this need.

SUMMARY OF THE INVENTION

In the view of the foregoing disadvantages inherent in the known types of combination waste receptacle devices now present in the prior art, the present invention provides an improved garbage receptacle with incorporated liner compartment. As such, the general purpose of the present invention, which will be described subsequently in greater detail, is to provide a new and improved garbage receptacle with incorporated liner compartment which has all the advantages of the prior art and none of the disadvantages.

To attain this, the present invention essentially comprises a container having an open upper end, a closed lower end, and a surrounding side wall therebetween. The container includes an intermediate lateral wall disposed upwardly of the closed lower end whereby a storage compartment is formed between the intermediate sliding shelf and the closed lower end. The surrounding side wall has an opening therein exposing the storage compartment. The opening has a removable access panel disposed therein. The storage compartment is dimensioned for holding a box of garbage liners therein. The intermediate sliding shelf has a central aperture therethrough, whereby a single liner is fed through the aperture to be extended up over the open upper end of the container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garbage receptacle with incorporated liner compartment which has all the advantages of the prior art combination waste receptacle devices and none of the disadvantages.

It is another object of the present invention to provide a new and improved garbage receptacle with incorporated liner compartment which may be easily and efficiently manufactured and marketed.

It is a further object of the present invention to provide a new and improved garbage receptacle with incorporated liner compartment which is of durable and reliable construction.

An even further object of the present invention is to provide a new and improved garbage receptacle with incorporated liner compartment which is susceptible of a low cost of manufacture with regard to both materials and labor, and which accordingly is then susceptible of low prices of sale to the consuming public, thereby making such a garbage receptacle with incorporated liner compartment economically available to the buying public.

Even still another object of the present invention is to provide a new and improved garbage receptacle with incorporated liner compartment for holding a quantity of garbage liners for convenient use.

Lastly, it is an object of the present invention to provide a new and improved garbage receptacle with incorporated liner compartment including a container having an open upper end, a closed lower end, and a surrounding side wall therebetween. The container includes an intermediate lateral wall disposed upwardly of the closed lower end whereby a storage compartment is formed between the intermediate sliding shelf and the closed lower end. The surrounding side wall has an opening therein exposing the storage compartment. The opening has a removable access panel disposed therein. The storage compartment is dimensioned for holding a box of garbage liners therein. The intermediate sliding shelf has a central aperture therethrough, whereby a single liner is fed through the aperture to be extended up over the open upper end of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

In the drawings, like elements are depicted by like reference numerals. The drawings are briefly described as follows.

The same reference numerals refer to the same parts through the various figures.

DESCRIPTION OF THE PREFERRED EMBODIMENT

Figure 2:
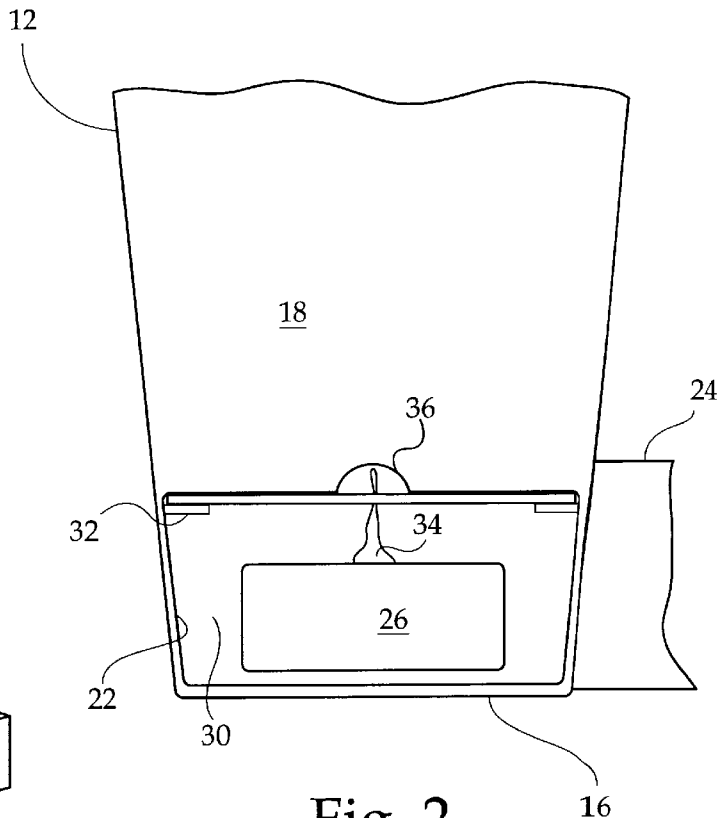
FIG. 2 is a front elevational view of the present invention.
Figure 1:
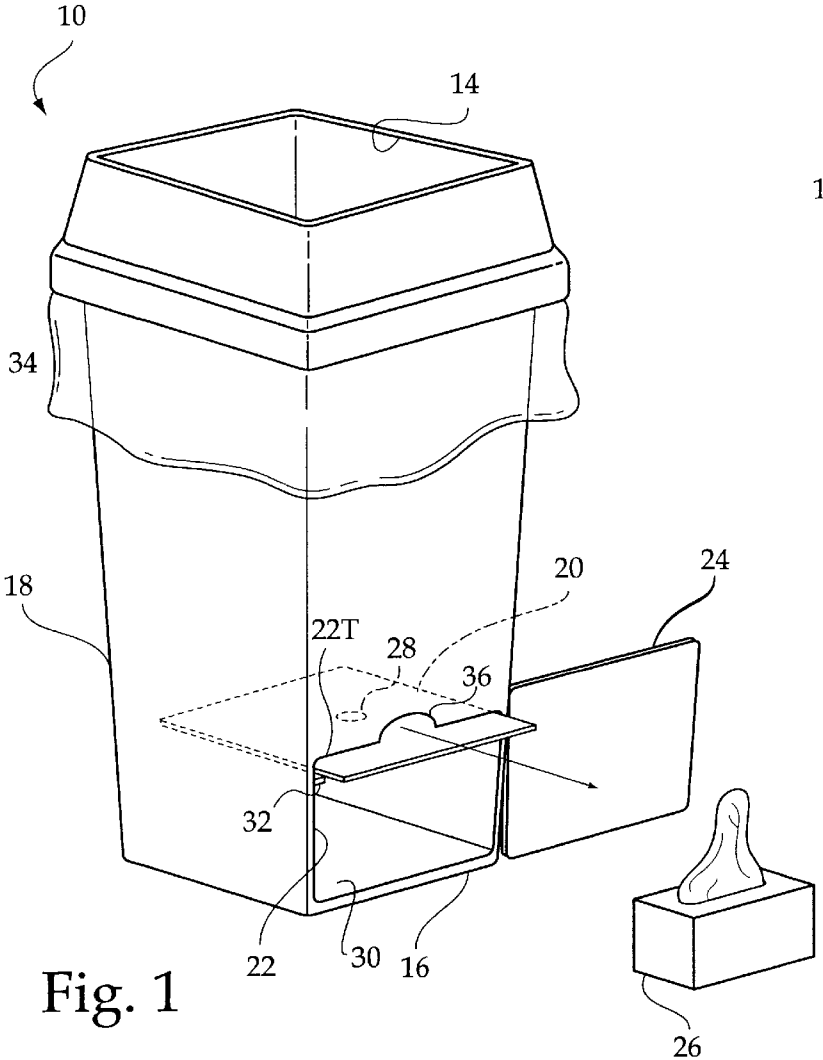
FIG. 1 is a perspective view of the preferred embodiment of the garbage receptacle with incorporated liner compartment constructed in accordance with the principles of the present invention.
Figure 3:
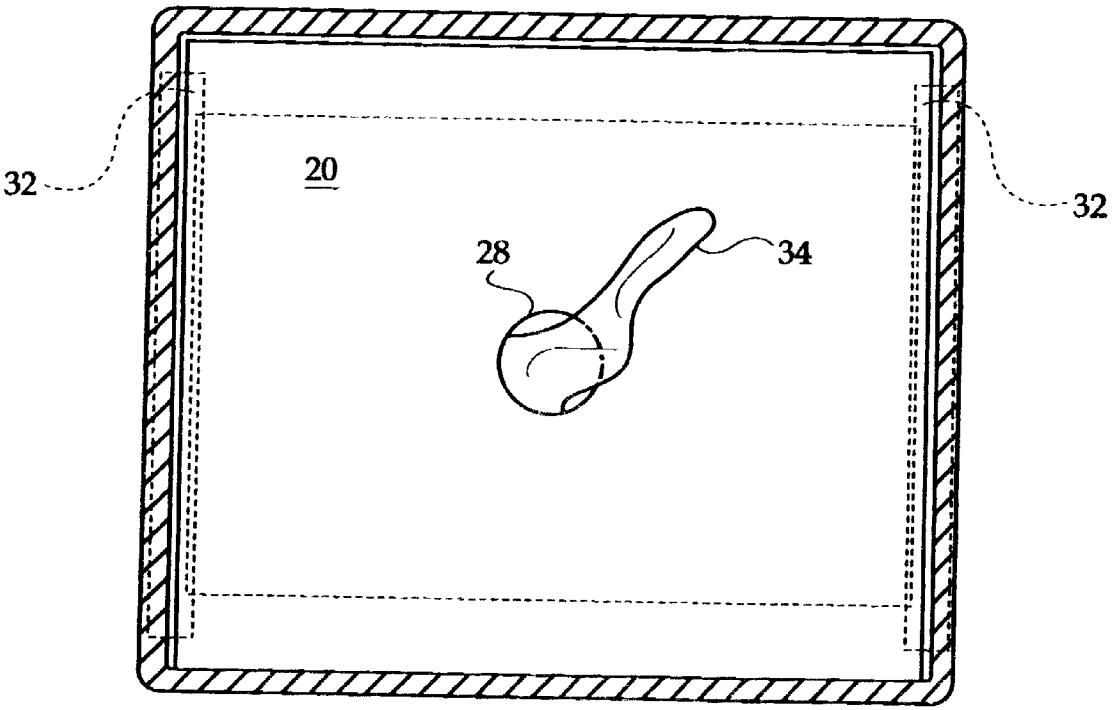
FIG. 3 is a cross-sectional plan view of the present invention.

With reference now to the drawings, and in particular, to FIGS. 1 through 3 thereof, the preferred embodiment of the new and improved garbage receptacle with incorporated liner compartment embodying the principles and concepts of the present invention and generally designated by the reference number 10 will be described.

Specifically, it will be noted in the various figures that the device relates to a garbage receptacle with incorporated liner compartment for holding a quantity of garbage liners for convenient use.

The present invention is essentially comprised of a container 12. The size and shape of the container 12 can be varied to accommodate various uses. The container 12 has an open upper end 14, a closed lower end 16, and a surrounding side wall 18 therebetween.

The container 12 includes an intermediate sliding shelf 20 disposed upwardly of the closed lower end 16 whereby a storage compartment 30 is formed between the intermediate sliding shelf 20 and the closed lower end 16. The surrounding side wall 18 has an opening 22 therein exposing the storage compartment 30. A pair of tracks 32 positioned on the side wall 18 under the shelf 20 on either side of said shelf 20 allows the shelf 20 to slide in and out of the opening 22. The side wall 18 has a removable access panel 24 hingedly mounted thereon for allowing access to the compartment 30 by selectively covering the opening 22. The storage compartment 30 is dimensioned for holding a box of garbage liners box 26 therein.

The intermediate sliding shelf 20 has a central aperture 28 therethrough, as illustrated in FIG. 3. The aperture 28 is sized to allow a single liner 34 to be fed therethrough, which is then pulled up over the open upper end 14 of the left container 12, as seen in FIG. 1. An arch 36 extends the opening 22 upward at its top edge 22T, thereby allowing the shelf 20 to slide into the container 12 with a liner 34 in place through the aperture 29.

In use, in order to replace the liner 34 in the container 12, the access panel 24 is opened and the sliding shelf 20 is pulled out from the interior of the container 12. A liner 34 is pulled from the garbage liners box 26 and threaded through the central aperture 28 in the shelf 20. The shelf 20 is then pushed back into the container 12. The arch 36 on the opening 22 ensures that there is sufficient space for the liner 34 to enter the container 10 without being pulled out of the aperture 28. Once the shelf 20 has been slid back into the container 12, the liner 34 can be pulled upward and over the open upper end 14 of the container 12 and the access panel 24 may be closed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A garbage receptacle with incorporated liner compartment for holding a quantity of garbage liners for convenient use comprising:

a container having an open upper end, a closed lower end, and a surrounding side wall therebetween;

an intermediate sliding shelf disposed within the container upwardly of the closed lower end whereby a storage compartment is formed between the sliding shelf and the closed lower end, the storage compartment being dimensioned for holding a box of garbage liners, wherein the intermediate sliding shelf has a central aperture therethrough, whereby a single liner may be fed through the central aperture to be extended up over the open upper end of the container;

an opening in the surrounding side wall of the container, the opening having a top edge, wherein said opening exposes the storage compartment; and tracks positioned on both side of the interior of the compartment below the sliding shelf, said tracks supporting the sliding shelf and allowing the sliding shelf to slide in and out of the compartment through the opening.

2. The garbage receptacle with incorporated liner compartment as recited in claim 1, further having a removable access panel hingedly attached to the surrounding side wall of the container for selectively covering the opening in the side wall.

3. The garbage receptacle with incorporated liner compartment as recited in claim 2, wherein the opening has an arch positioned on the top edge thereof for allowing the sliding shelf to be slid back into the compartment through the opening with the liner remaining in place within the central aperture.

* * * * *